US007465141B1

(12) United States Patent
Fournier et al.

(10) Patent No.: US 7,465,141 B1
(45) Date of Patent: Dec. 16, 2008

(54) MULTILEVEL VERTICAL GENERAL AVIATION HANGAR

(75) Inventors: Oscar A. Fournier, Brentwood, MO (US); John N. Bowman, St. Petersburg, FL (US); Thomas Brew, St. Petersburg, FL (US); Glenn C. Friedly, S. Pasadena, FL (US); Steven Lange, St. Petersburg, FL (US); Eric P. Olsen, Safety Harbor, FL (US); William D. Slicker, St. Petersburg, FL (US); Eric A. Whitted, St. Petersburg, FL (US)

(73) Assignee: A-V Stak Systems Inc., St. Petersburg, FL (US)

( * ) Notice: Subject to any disclaimer, the term of this patent is extended or adjusted under 35 U.S.C. 154(b) by 248 days.

(21) Appl. No.: 11/339,083

(22) Filed: Jan. 25, 2006
(Under 37 CFR 1.47)

Related U.S. Application Data

(60) Provisional application No. 60/593,555, filed on Jan. 25, 2005.

(51) Int. Cl.
*E04H 6/12* (2006.01)

(52) U.S. Cl. ..... 414/234; 414/239; 414/241; 414/264

(58) Field of Classification Search ..... 414/234, 414/239, 241, 253, 264; 104/35; 410/1
See application file for complete search history.

(56) References Cited

U.S. PATENT DOCUMENTS

| | | | | | |
|---|---|---|---|---|---|
| 3,042,228 | A | | 7/1962 | Frangos | |
| 3,737,057 | A | * | 6/1973 | Neumann et al. | 414/231 |
| 3,756,419 | A | | 9/1973 | Dean | |
| 5,013,203 | A | * | 5/1991 | Wakabayashi | 198/465.3 |
| 5,238,348 | A | * | 8/1993 | Reimer | 414/254 |
| 5,314,284 | A | * | 5/1994 | Tsai | 414/234 |
| 5,573,364 | A | | 11/1996 | Schneider et al. | |
| 5,678,972 | A | * | 10/1997 | Bockler et al. | 414/239 |
| 6,109,853 | A | * | 8/2000 | Paulmichl | 414/239 |
| 6,302,634 | B1 | * | 10/2001 | Grenader | 414/240 |
| 6,328,521 | B1 | * | 12/2001 | Givati | 414/234 |
| 6,336,781 | B1 | * | 1/2002 | Doppelmayr et al. | 414/253 |
| 6,502,011 | B2 | * | 12/2002 | Haag | 700/217 |
| 6,851,921 | B2 | | 2/2005 | Haag | |
| 2002/0176767 | A1 | * | 11/2002 | Gisselberg | 414/261 |

FOREIGN PATENT DOCUMENTS

| | | | | |
|---|---|---|---|---|
| JP | 3-221673 | * | 9/1991 | 414/264 |

OTHER PUBLICATIONS

Randy Diamond, "A Clearwater Businessman . . . Parking in Packed Cities", The Tampa Tribune, Jul. 3, 2005, p. 1 et seq., Tampa, Florida, USA.

* cited by examiner

*Primary Examiner*—James Keenan
(74) *Attorney, Agent, or Firm*—Edward P. Dutkiewicz, P.A.

(57) ABSTRACT

A multilevel vertical general aviation hangar, comprising a traffic inflow/outflow path and a pallet stack subsystem. There is also a pallet turntable located with the path. A pallet shuttle moves the pallet and contained vehicle from the turntable to a lift. The lift moves the pallet and vehicle to a predetermined location within a storage structure.

3 Claims, 7 Drawing Sheets

FIG 2
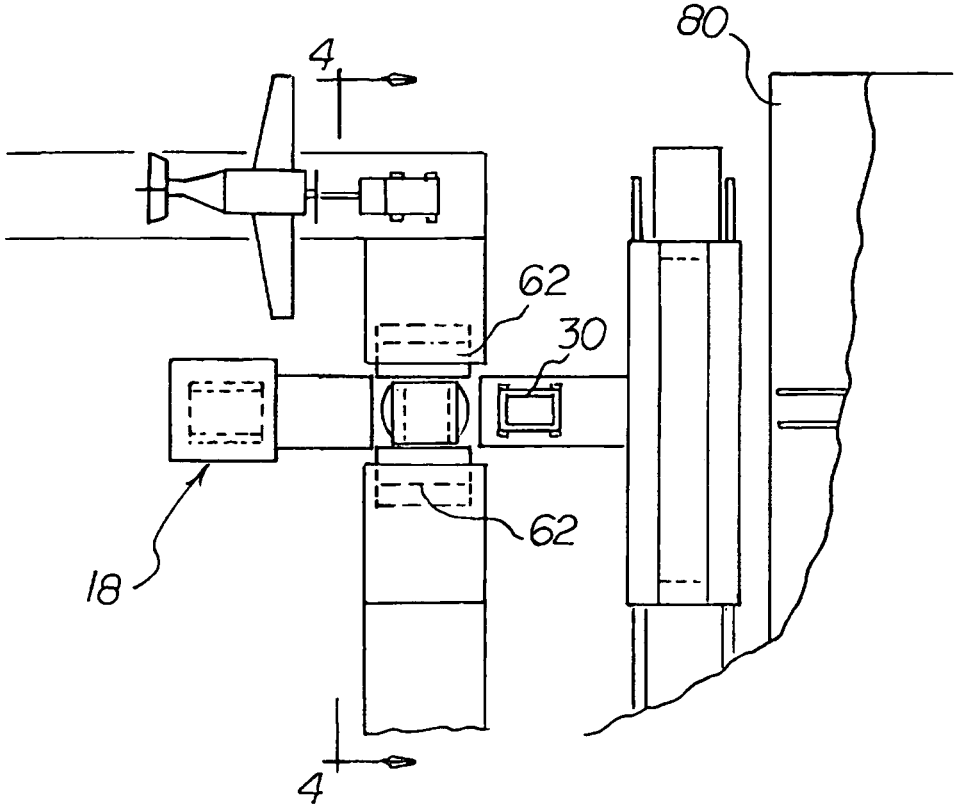
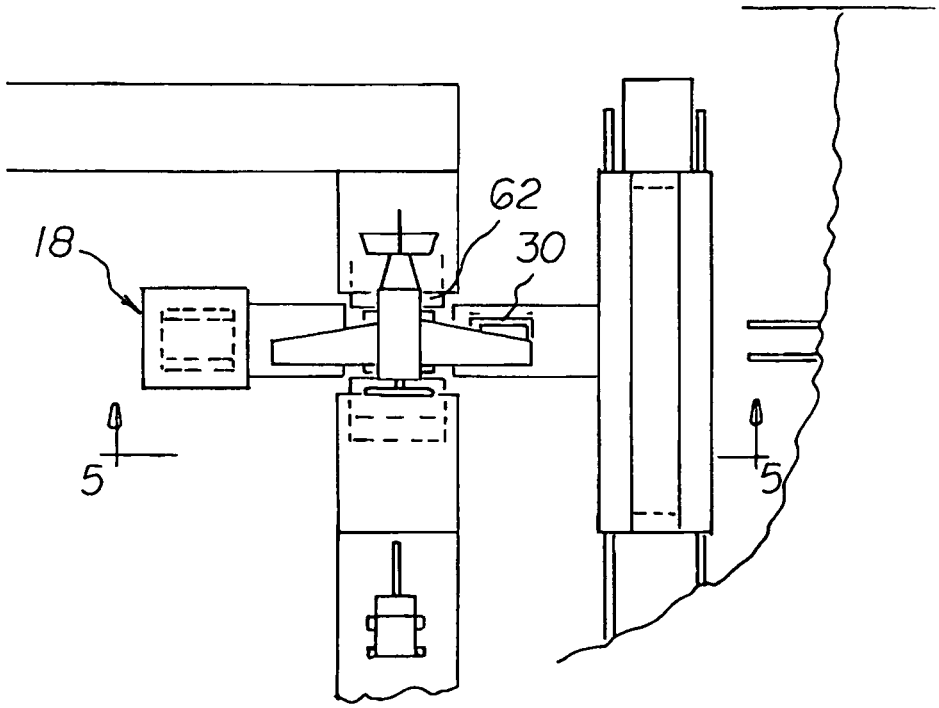
FIG 3

FIG 4
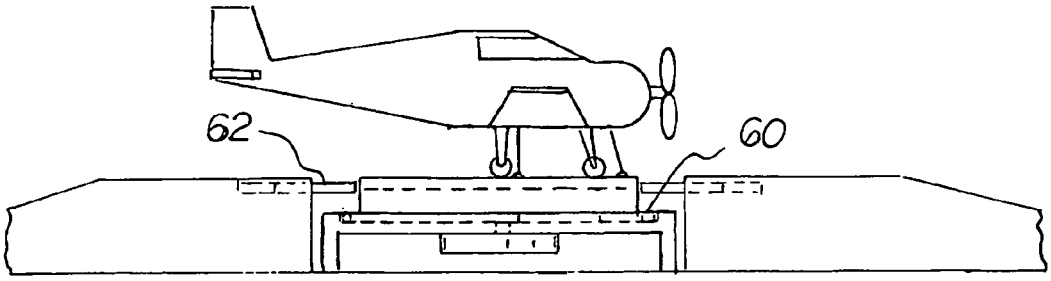
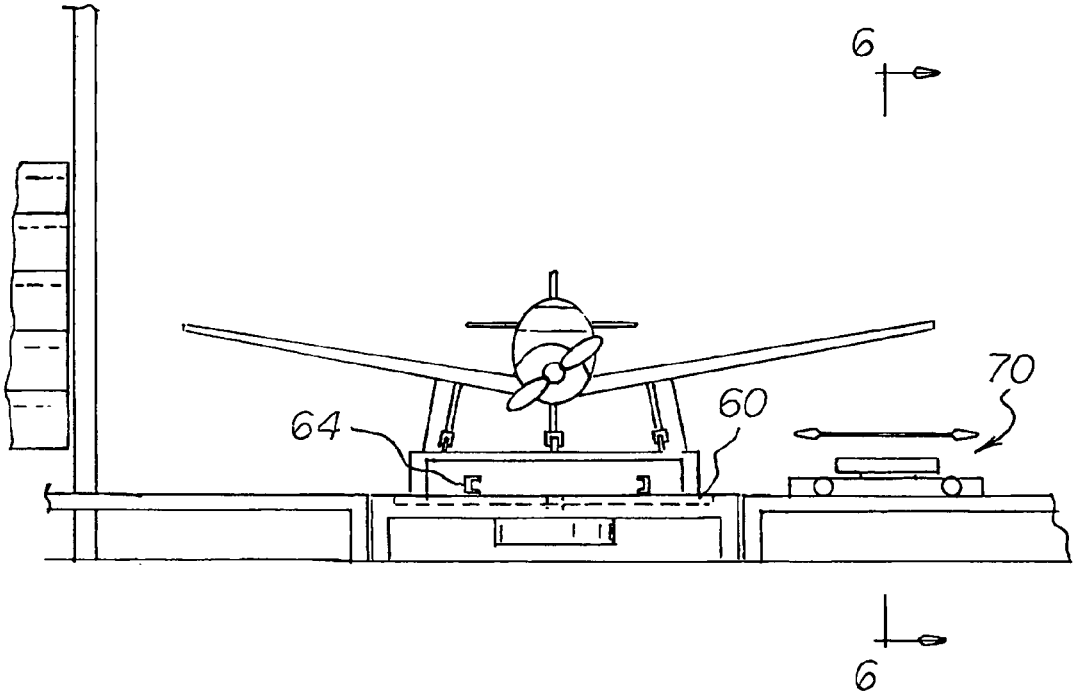
FIG 5

FIG 6
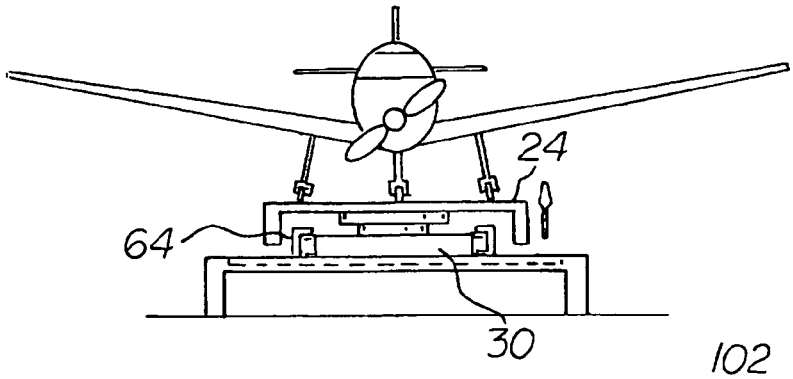
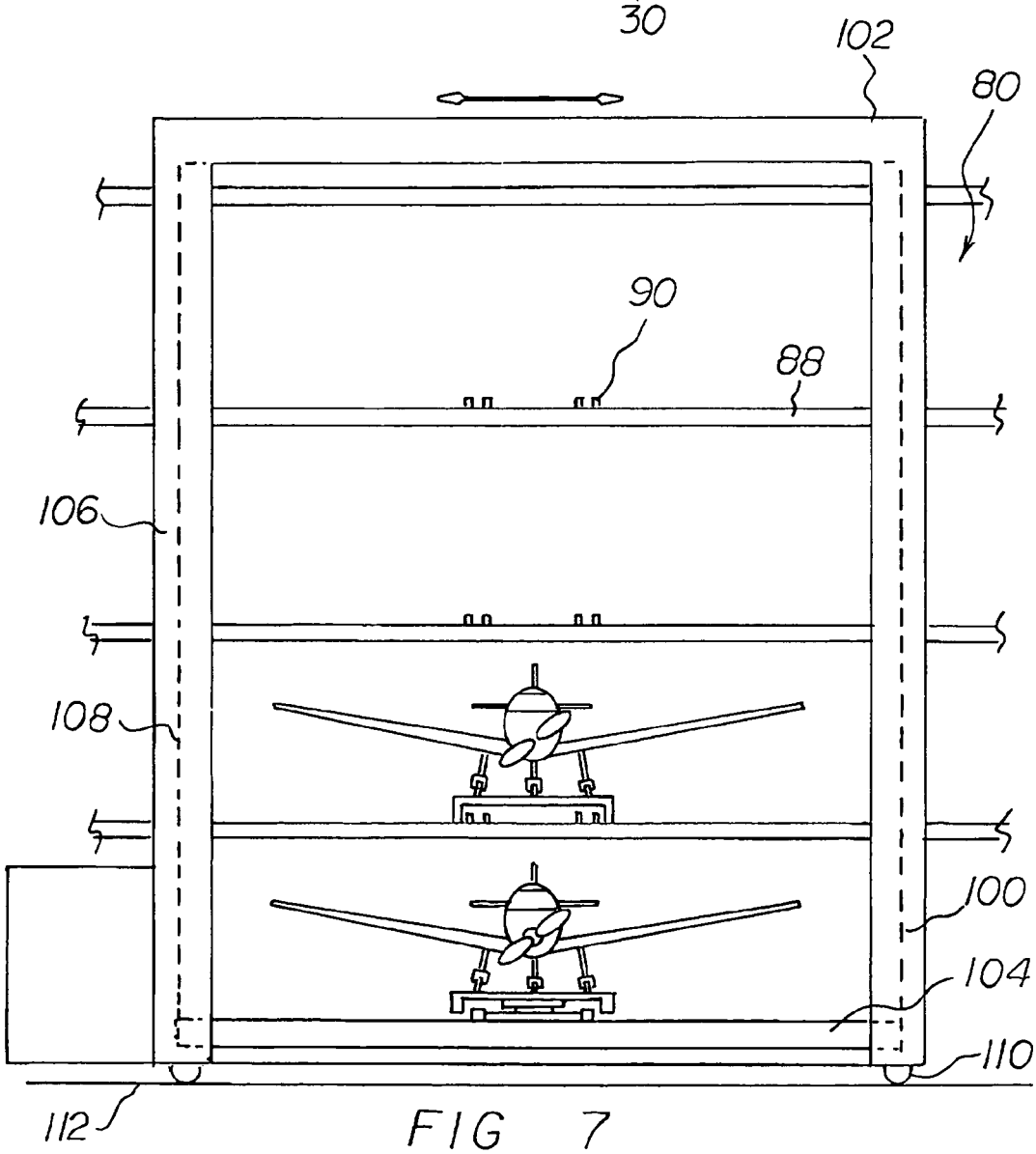
FIG 7

FIG 10
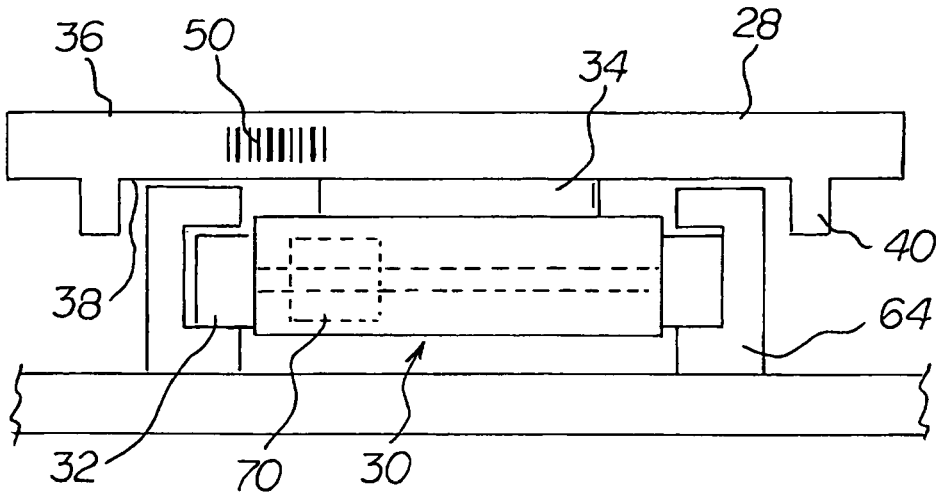
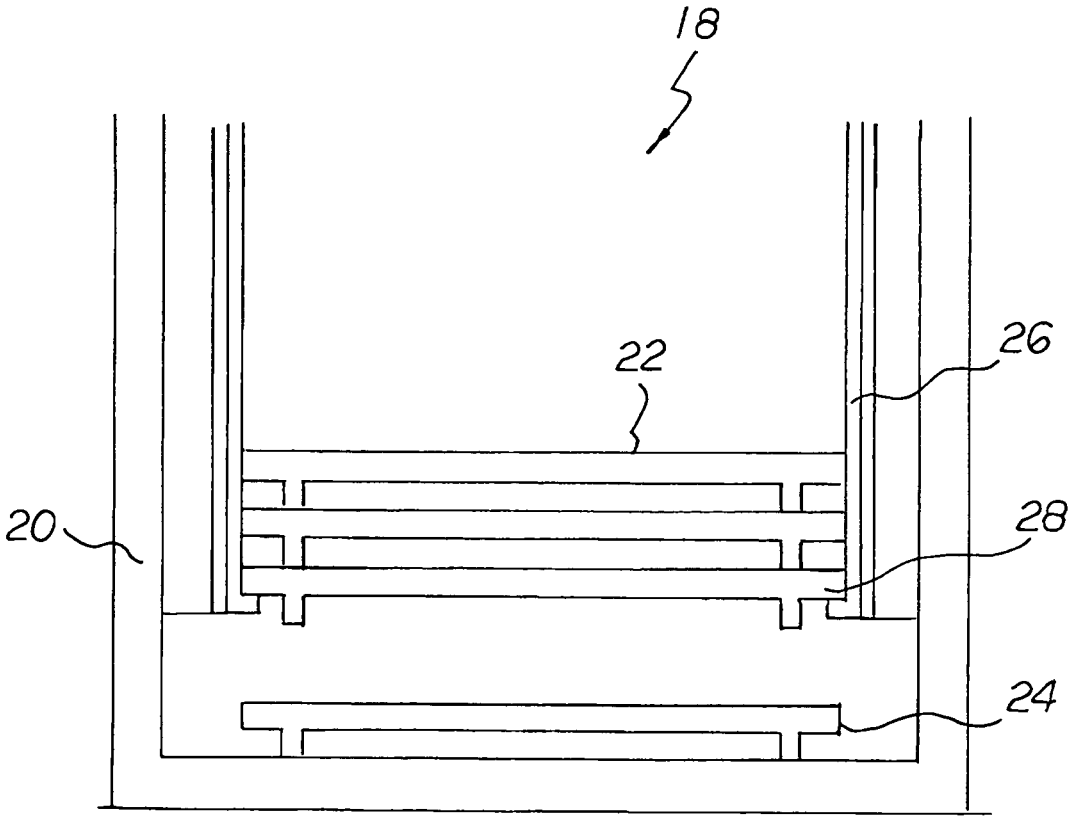
FIG 11

FIG 12
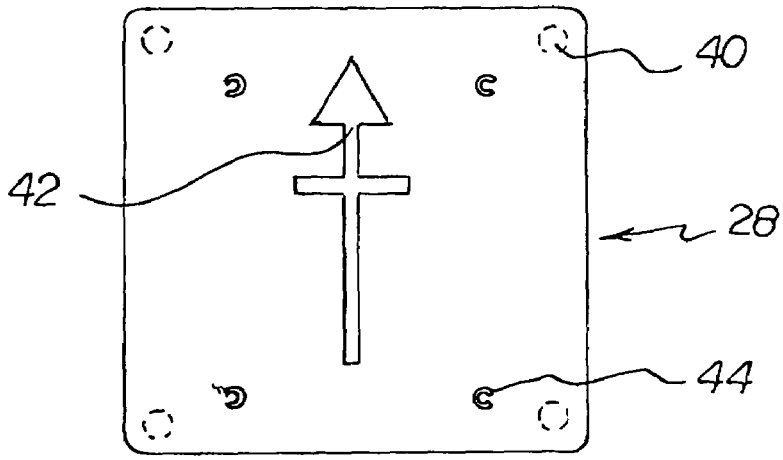
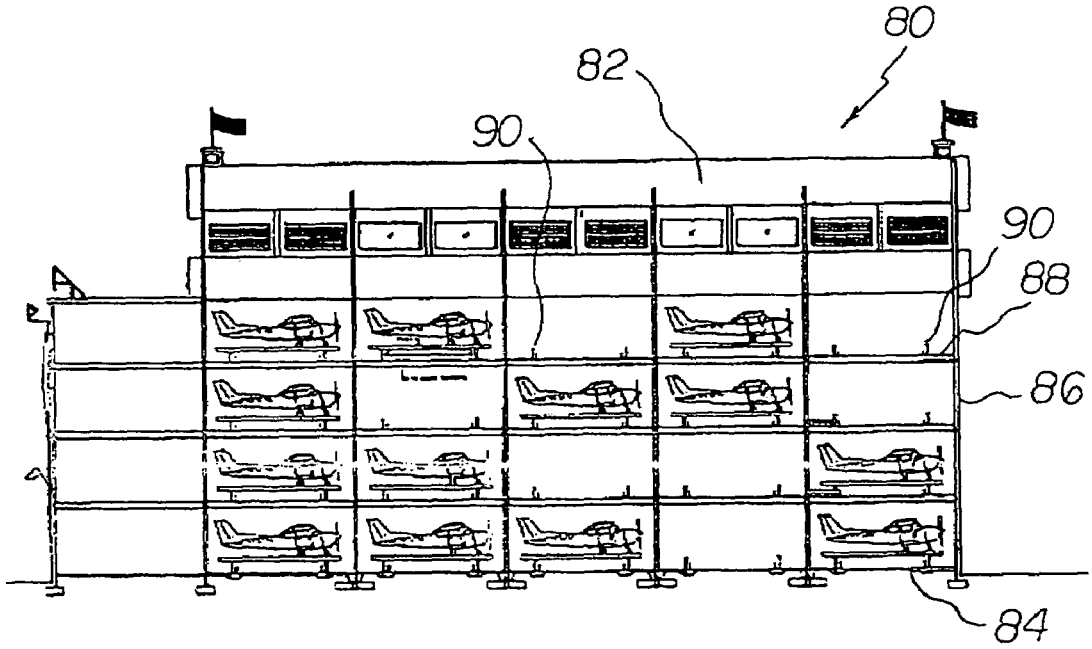
FIG 13

MULTILEVEL VERTICAL GENERAL AVIATION HANGAR

RELATED APPLICATION

The present application is based upon a provisional application Ser. No. 60/593,555, filed 25 Jan. 2005, and this application claims the priority date of the above stated provisional application.

BACKGROUND OF THE INVENTION

1. Field of the Invention

The present invention relates to a Multilevel vertical general aviation hangar and more particularly pertains to storing and managing the storage of vehicles.

2. Description of the Prior Art

The use of devices and systems to store vehicles is known in the prior art. More specifically, devices and systems to store vehicles previously devised and utilized for the purpose of storing vehicles are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,851,921 issued on 8 Feb., 2005 to Haag discloses an Automated Parking Garage. U.S. Pat. No. 5,564,879 issued on 15 Oct. 1996 to Noguchi discloses a Three-Dimensional Warehouse. U.S. Pat. No. 4,527,937 issued on 9 Jul., 1985 to Tomasello discloses an Automatic Storage and Distribution System. U.S. Pat. No. 6,637,351 issued on 28 Oct., 2003 to Brennan et al discloses a Shipping Pallet With Retractable Rails. Lastly, U.S. Pat. No. 4,213,624 issued on 22 Jul., 1980 to Sanders discloses a Pallet Transport System.

While these devices fulfill their respective, particular objectives and requirements, the aforementioned patents do not describe a Multilevel vertical general aviation hangar that allows for storing and managing the storage of vehicles.

In this respect, the Multilevel vertical general aviation hangar according to the present invention substantially departs from the conventional concepts and designs of the prior art, and in doing so provides an apparatus primarily developed for the purpose of storing and managing the storage of vehicles.

Therefore, it can be appreciated that there exists a continuing need for a new and improved Multilevel vertical general aviation hangar which can be used for storing and managing the storage of vehicles. In this regard, the present invention substantially fulfills this need.

SUMMARY OF THE INVENTION

In view of the foregoing disadvantages inherent in the known types of devices and systems to store vehicles now present in the prior art, the present invention provides an improved Multilevel vertical general aviation hangar. As such, the general purpose of the present invention, which will be described subsequently in greater detail, is to provide a new and improved Multilevel vertical general aviation hangar and method which has all the advantages of the prior art and none of the disadvantages.

To attain this, the present invention essentially comprises a multilevel vertical general aviation hangar comprises several components, in combination.

First provided is a traffic inflow/outflow path having a surface. The traffic inflow/outflow path has an associated lighting system and an associated traffic direction system. The path has a one directional flow to allow traffic to move in one direction.

Next provided is a pallet stack subsystem. The pallet stack subsystem is located adjacent to the traffic path. The pallet stack subsystem comprises a pallet rack having an top-of-stack and a bottom-of-stack. The rack has an associated hydraulic pallet lift subsystem so as to allow the bottom-of-stack pallet to be moved in and out of the rack. The rack contains at least one pallet. The pallet stack subsystem also has an associated pallet shuttle. The shuttle has at least one pair of rail mated wheels and a hydraulically upwardly motivated pallet lift.

Next provided is a pallet. The pallet has a generally rectangular configuration and is associated with the pallet stack subsystem. The pallet has a flat planar upper facing vehicle recipient surface and a lower, downward facing, shuttle pallet-lift recipient surface. The lower surface of the pallet is configured to receive and mate with the hydraulically upwardly motivated pallet lift. The pallet has a thickness between the upper and lower surfaces. The pallet also has four downwardly disposed corner legs, with the legs being disposed a first distance from each other.

Next provided is a pallet turntable. The turntable has a diameter line. The pallet turntable is located adjacent the pallet rack and is configured to receive a pallet from the pallet rack. The pallet turntable is located within the traffic inflow/outflow path. The turntable has at least one associated inflow path leaf, thereby coupling the pallet turntable to the traffic inflow and forming a turntable ingress path. The turntable also has at least one associated outflow path leaf, thereby coupling the pallet turntable to the traffic outflow and forming a turntable egress path. Each leaf couples the pallet turntable, and a pallet that is positioned on the turntable, with the traffic path in a continuous fashion. The turntable has a pair of associated shuttle rails located on each side of and about the diameter line of the turntable.

Next provided is a pallet shuttle. The pallet shuttle has a generally rectangular configuration. The pallet shuttle has four wheels and an upper surface having a longitudinal length and a lateral width and a lower surface having a longitudinal length and a lateral width. The pallet shuttle has a thickness between the upper and lower surfaces. The upper surface has an associated upwardly disposed hydraulic lift. The lower surface has a pair of longitudinally oriented, spaced downwardly disposed stems. The wheels are coupled to the stems and are mate-able to the shuttle rails of the turntable. The width of the pallet shuttle is a second distance. The width of the pallet shuttle is less than the first distance width of the downwardly disposed pallet legs so that the shuttle is able to move between the downwardly disposed legs of the pallet. The pallet shuttle ha at least one electrical motor associated with the wheels. The motor also couples to a hydraulic pump and a reservoir. There is provided at least one hydraulic fluid tubing thereby providing power to operate the hydraulic pallet lift.

Next provided is a storage structure. The storage structure has a generally rectangular configuration with a roof, a floor, and supporting side structures. The side structures define a structure having a front face, a rear face, and two parallel side faces. The storage structure also has at plurality of levels. Each level has a plurality of pairs of storage rails. Each of the storage rails has a length and a width. The storage rails have the same configuration and rail-to-rail orientation as the rails of the turntable, so as to allow the shuttle to mate with the storage rails. Each pair of storage rails has a plurality of locations along the length of the pairs of storage rails defined by a coordinate system and a set of coordinates. Each set of coordinates defines a storage space along the length of the storage rails. Each storage space is sized to accommodate the length, width, and height of an airplane. Each storage space is identified by use of indicia.

Next provided is a coordinate storage computer subsystem, having a computer with a memory and a processor. The coordinate storage subsystem is configured to store the storage space coordinates. The coordinate storage subsystem is also configured to transmit information regarding the location of indicia.

Lastly provided is a travel/lift subsystem. The travel/lift subsystem comprises a generally rectangular upwardly disposed frame having an upper support, a lower support, and two parallel side supports. The travel/lift subsystem has an associated hydraulic lift configured to move in an upward and downward direction. The lift also has an associated hydraulic travel system, with an associated travel track having a defined length, to provide for lateral movement of the travel/lift subsystem in a side-to-side fashion. The travel of the lift subsystem is a defined distance of travel along the length of the travel track. The side-to-side and up-and-down movement gives the travel/lift subsystem a two dimensional planar movement along the length of the travel track. The travel/lift subsystem is located adjacent to the turntable and is on the opposing side of the turntable from the pallet rack. The travel/lift subsystem is located along one side of the storage structure. The travel/lift subsystem is electronically coupled to the coordinate storage computer subsystem so that the computer can control the movement of the travel/lift subsystem.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved Multilevel vertical general aviation hangar which has all of the advantages of the prior art devices and systems to store vehicles and none of the disadvantages.

It is another object of the present invention to provide a new and improved multilevel vertical general aviation hangar which may be easily and efficiently manufactured and marketed.

It is further object of the present invention to provide a new and improved multilevel vertical general aviation hangar which is of durable and reliable constructions.

Even still another object of the present invention is to provide a multilevel vertical general aviation hangar for storing and managing the storage of vehicles.

Lastly, it is an object of the present invention to provide a new and improved Multilevel vertical general aviation hangar, comprising a traffic inflow/outflow path and a pallet stack subsystem. There is also a pallet turntable located with the path. A pallet shuttle moves the pallet and contained vehicle from the turntable to a lift. The lift moves the pallet and vehicle to a predetermined location within a storage structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a close-up planar overview of circle "2" of FIG. 1 demonstrating the relationship of the tug, aircraft and system as the aircraft is brought to the system for storage.

FIG. 3 is a close-up planar overview of the aircraft in relation to the rack, travel path and travel/lift subsystem.

FIG. 4 is a side elevation taken along line 4-4 of FIG. 2, showing the aircraft on the pallet, which is on the turntable. Note the extended leafs.

FIG. 5 is a side elevation taken along line 5-5 of FIG. 3, showing the aircraft on the pallet with the approaching shuttle.

FIG. 6 is a side elevation of the shuttle/pallet combination after the pallet is turned ninety degrees for storage.

FIG. 7 is a side elevation taken along line 6-6 of FIG. 5 showing the view into the lift and storage structure behind the lift.

FIG. 10 is a side elevation of the rail, shuttle, and pallet relationship, showing the shuttle riding inside of the rails with the pallet being positioned above the rails.

FIG. 11 is a side elevation of the pallet stack, showing the stacked pallets and the hydraulic lift subsystem for allowing the removal of the bottom-of-stack pallet.

FIG. 12 is a above planar view of the pallet showing the directional marking and the tie-down points.

FIG. 13 is a side elevation of the structure showing the aircraft placed on pallets and stored in position.

The same reference numerals refer to the same parts throughout the various Figures.

DESCRIPTION OF THE PREFERRED EMBODIMENT

Figure 1:
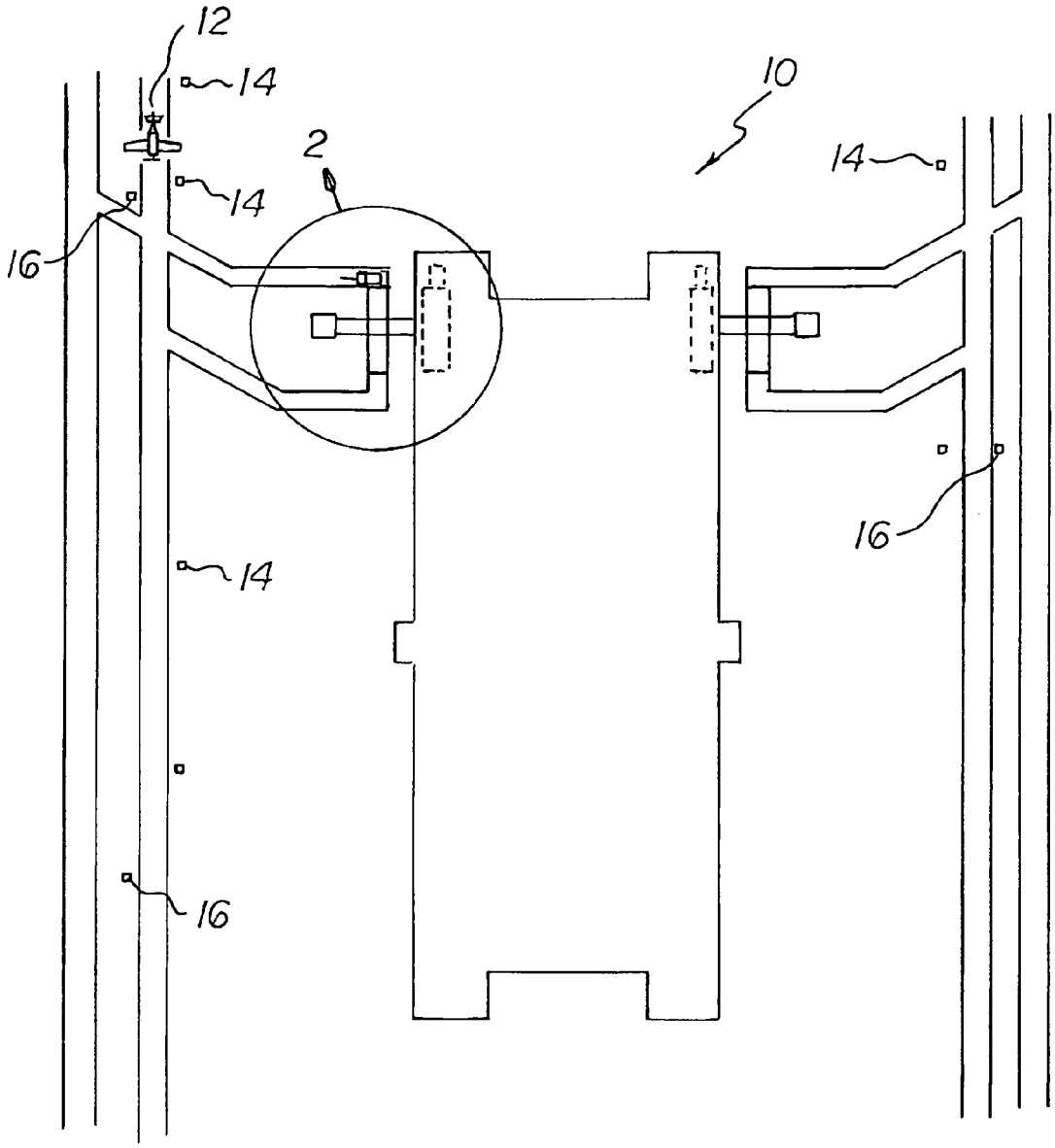
FIG. 1 is planar overview of the system showing a taxiing path and the garage system in association with each other.
Figure 8:
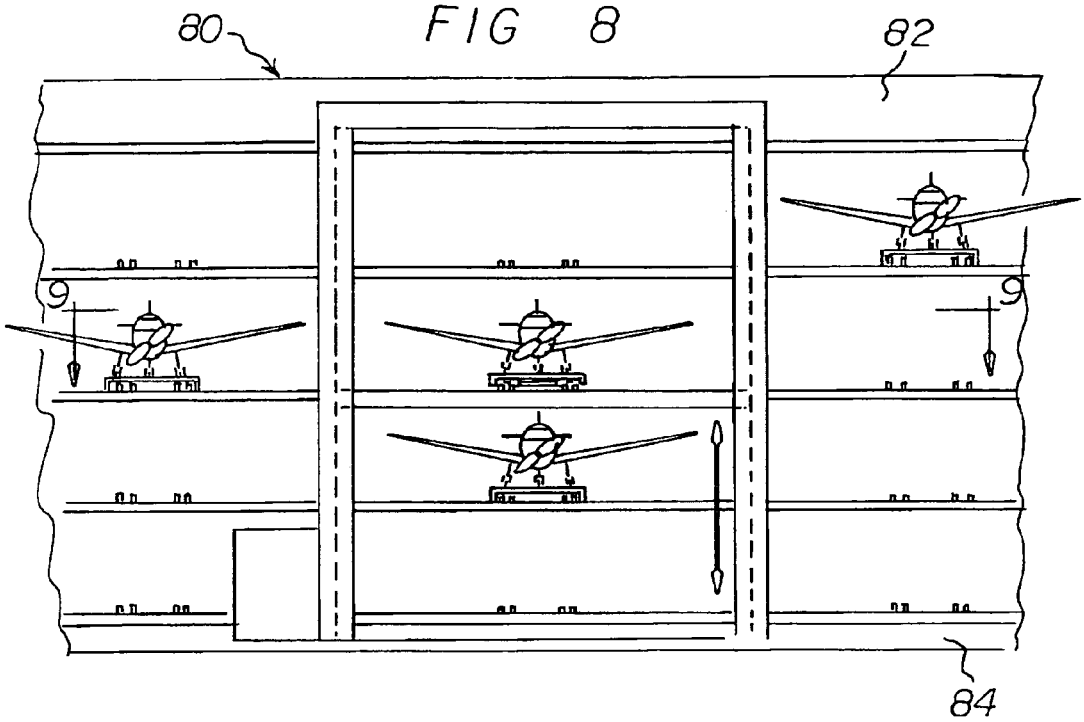
FIG. 8 is a side elevation of the travel/lift demonstrating the lift elevating an aircraft for storage.
Figure 9:
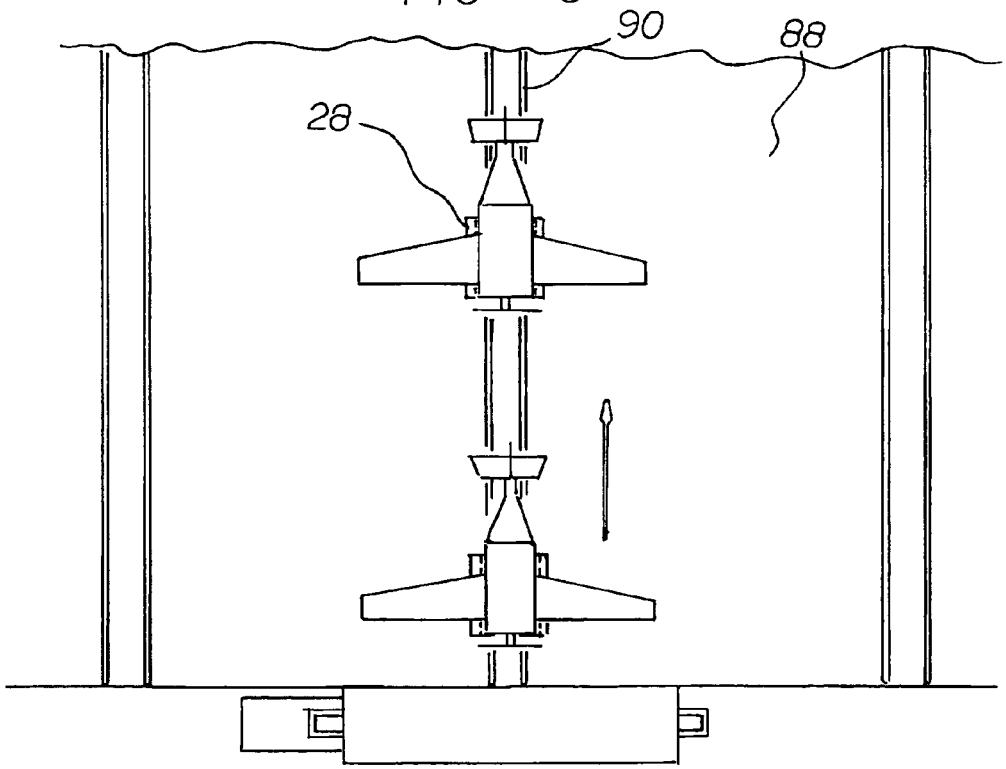
FIG. 9 is a planar overview of the storage structure taken along line 9-9 of FIG. 8, showing aircraft stored on the pallets, with the pallets positioned upon the top of the structure rail system.

With reference now to the drawings, and in particular to FIG. 1 thereof, the preferred embodiment of the new and improved Multilevel vertical general aviation hangar embodying the principles and concepts of the present invention and generally designated by the reference numeral 10 will be described.

The present invention, the Multilevel vertical general aviation hangar 10 is comprised of a plurality of components. Such components in their broadest context include a path, a turntable, a pallet and a travel/lift. Such components are individually configured and correlated with respect to each other so as to attain the desired objective.

A Multilevel vertical general aviation hangar 10 comprising several components, in combination is described below.

First provided is a traffic inflow/outflow path 12 having a surface. In the preferred embodiment the surface is concrete, though one skilled in the art would recognize that the surface may be any firm surface, such as asphalt, crushed stone or other compacted material. The traffic inflow/outflow path has an associated lighting system 14 and an associated traffic direction system 16. The path has a one directional flow to allow traffic to move in one direction.

In another embodiment, the traffic pattern along the path may be in a to-and-fro direction.

Next provided is a pallet stack subsystem 18. The pallet stack subsystem is located adjacent to the traffic path. The pallet stack subsystem comprises a pallet rack 20 having an top-of-stack 22 and a bottom-of-stack 24. The rack has an associated hydraulic pallet lift subsystem 26 so as to allow the bottom-of-stack pallet to be moved in and out of the rack. The rack contains at least one pallet. The pallet stack subsystem is configured to allow the containment of one or more than one pallet 28.

The pallet stack subsystem also has an associated pallet shuttle 30. The shuttle has at least one pair of rail mated wheels 32 and a hydraulically upwardly motivated pallet lift 34.

In another embodiment, the pallet may be moved from the top of the stack. One skilled in the art would recognize that the location of the delivered pallet is one dictated by engineering considerations, and is a matter of engineering choice.

Next provided is a pallet 28. The pallet has a generally rectangular configuration and is associated with the pallet stack subsystem. The pallet has a flat planar upper facing vehicle recipient surface 36 and a lower, downward facing, shuttle pallet-lift recipient surface 38. The lower surface of the pallet is configured to receive and mate with the hydraulically upwardly motivated pallet lift. The pallet has a thickness between the upper and lower surfaces. The pallet also has four downwardly disposed corner legs 40, with the legs being disposed a first distance from each other.

The pallet may have direction marks 42 on the upper surface to allow a user to position the vehicle in the appropriate location on the pallet. The pallet also is configured to have securement locations 44 to allow a user to secure a vehicle to the pallet surface. Such securement may be accomplished by such devices as rope, cables, tie-downs, straps, steel strips or bars.

In the preferred embodiment, each pallet has an identifying indicia 50, so that when a vehicle is place on the pallet, the vehicle is then identified by the pallet indicia. The indicia is the type that is readable, by scanning or radio frequency, so that a computer driven shuttle could identify each pallet, and hence, the contained vehicle by way of the indicia.

Next provided is a pallet turntable 60. The turntable has a diameter line. The pallet turntable is located adjacent the pallet rack and is configured to receive a pallet from the pallet rack. The pallet turntable is located within the traffic inflow/outflow path. The turntable has at least one associated inflow path leaf 62, thereby coupling the pallet turntable to the traffic inflow and forming a turntable ingress path. The turntable also has at least one associated outflow path leaf, thereby coupling the pallet turntable to the traffic outflow and forming a turntable egress path. Each leaf couples the pallet turntable, and a pallet that is positioned on the turntable, with the traffic path in a continuous fashion. The turntable has a pair of associated shuttle rails 64 located on each side of and about the diameter line of the turntable.

In the preferred embodiment, the turntable has a generally circular configuration with a diameter. One skilled in the art would recognize that the pallet may be other geometric shapes, in that there are other compensating mechanisms that would accommodate and allow the usage of such shapes.

The pallet shuttle 30 has a generally rectangular configuration. The pallet shuttle has four wheels 32 and an upper surface having a longitudinal length and a lateral width and a lower surface having a longitudinal length and a lateral width. The pallet shuttle has a thickness between the upper and lower surfaces. The upper surface has an associated upwardly disposed hydraulic lift 34. The wheels are coupled to the shuttle and are mate-able to the shuttle rails 64 of the turntable. The shuttle wheels are mated inside of the rail, which are generally C-shaped. This configuration allows the wheels to ride within the rails, while allowing the pallet to be rested on the top of the rails. This, in turn, allows the shuttle to be of a smaller size in width and length than that of the pallet. The width of the pallet shuttle is a second distance. The width of the pallet shuttle is less than the first distance width of the downwardly disposed pallet legs so that the shuttle is able to move between the downwardly disposed legs of the pallet.

The pallet shuttle has at least one electrical motor 70 associated with the wheels. The motor also couples to a hydraulic pump and a reservoir. There is provided at least one hydraulic fluid tubing thereby providing power to operate the hydraulic pallet lift 34.

The pallet shuttle may have a conducting means, such as wire (not shown), to power the motor of the shuttle. In another embodiment, the rails may conduct energy to drive the shuttle motor (not shown), such as is commonly used in subway systems. One skilled in the art would recognize that the pallet shuttle may have a plurality of motors to drive the shuttle movement and the shuttle lift hydraulic system.

Next provided is a storage structure 80. The storage structure has a generally rectangular configuration with a roof 82, a floor 84, and supporting side structures 86. The side structures define a structure having a front face, a rear face, and two parallel side faces. The storage structure also has at plurality of levels 88. Each level has a plurality of pairs of storage rails 90. Each of the storage rails has a length and a width. The storage rails have the same configuration and rail-to-rail orientation as the rails of the turntable, so as to allow the shuttle to mate with the storage rails. Each pair of storage rails has a plurality of locations along the length of the pairs of storage rails defined by a coordinate system and a set of coordinates. Each set of coordinates defines a storage space along the length of the storage rails. Each storage space is sized to accommodate the length, width, and height of an airplane. Each storage space is identified by use of indicia.

The storage structure may be opened faced, that is, not having any sides, or it may be an enclosed building. One skilled in the art would recognize that if the storage structure is enclosed, there will be a ventilation system (not shown), either active or passive, or both combined, to remove gasses and vapors that would tend to accumulate within the structure. There is also provided a hazardous materials recapture surface (not shown), located along the floor of the structure, so that leaked hazardous material, such as gasoline, may be prevented from polluting the soil and water in the area of the structure.

Next provided is a coordinate storage computer subsystem (not shown), having a computer with a memory and a processor. The coordinate storage subsystem is configured to store the storage space coordinates. The coordinate storage subsystem is also configured to transmit information regarding the location of indicia.

Lastly provided is a travel/lift subsystem 100. The travel/lift subsystem comprises a generally rectangular upwardly disposed frame having an upper support 102, a lower support 104, and two parallel side supports 106. The travel/lift subsystem has an associated hydraulic lift 108 configured to move in an upward and downward direction. The lift also has an associated hydraulic travel system 110, with an associated travel track 112 having a defined length, to provide for lateral movement of the travel/lift subsystem in a side-to-side fashion. The travel of the lift subsystem is a defined distance of travel along the length of the travel track. The side-to-side and up-and-down movement gives the travel/lift subsystem a two dimensional planar movement along the length of the travel track. The travel/lift subsystem is located adjacent to the turntable and is on the opposing side of the turntable from the pallet rack. The travel/lift subsystem is located along one side of the storage structure. The travel/lift subsystem is electronically coupled (not shown) to the coordinate storage computer subsystem so that the computer can control the movement of the travel/lift subsystem. One skilled in the art would recognize that the electronically coupling of the computer and the lift may be achieved by hard wiring or by other means, such as RF and infra red coupling. In the preferred embodiment, the coupling is accomplished with hard wiring (not shown).

In practice, a vehicle would be driven or towed along the path to the location of the turntable. The computer would be activated to cause a pallet to be taken from the rack and transported, via a shuttle, to the turntable. The shuttle would deposit the pallet on the turntable. The turntable would turn ninety degrees so that the pallet was in line with the line of travel of the vehicle. The outflow and inflow path leafs would extend or raise up so that they would be close to the pallet surface. In this way, the path would be continuous up to and across the pallet. This would allow the vehicle to be driven or towed on to the pallet without any significant interruption in the surface. The vehicle would place appropriately on the pallet and then secured, if necessary and desired.

The operator would, at this time, enter the identification number of the vehicle, or the desired proposed location of the vehicle to be stored. The computer, depending on the system used, would either randomly assign a storage location, thereby assigning the vehicle with that storage location number, or the computer would identify the vehicle and direct the shuttle to place the pallet with the vehicle at the pre-assigned location. There are numerous systems that can be employed for vehicle placement.

Once the vehicle is secure, or ready for placement, the leafs of the path would retract and dissociate from the path and the turntable would again turn ninety degrees, so that the pallet would be in alignment for the pallet shuttle to carry the pallet to the lift. The shuttle would be activated and pass beneath the pallet, and between the downward legs of the pallet. The shuttle would then extend the lifting hydraulic and the pallet, along with the vehicle, would be lifted. The shuttle would carry the pallet and vehicle to the travel/lift. The shuttle would enter the travel/lift, and the shuttle would be lifted and transported laterally to the desired level and location of the structure. The shuttle would carry the pallet from the lift and into the structure according to the direction and instruction the shuttle received from the computer. Once the shuttle was at the desired location, the pallet would be let down on to the rails. The shuttle would be withdrawn and the storage sequence would be complete.

Removal of a vehicle would comprise a reversal of the steps, with the computer dispatching a shuttle to the proper vehicle location for retrieval.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A multilevel vertical general aviation hangar, comprising:

a traffic inflow/outflow path having a surface;

a pallet stack subsystem located adjacent to the traffic path;

at least one pallet being associated with the pallet stack subsystem, the pallet having downwardly disposed legs having a width there between, the pallet being configured to be contained within the pallet stack subsystem a pallet turntable ingress path and a pallet turntable egress path located within the traffic path;

a pallet turntable located within the traffic path;

a pallet shuttle operatively coupling the pallet turntable and a storage structure having a side surface, the pallet shuttle having a width being less than the width between the downwardly disposed pallet legs so that the shuttle is able to move between the downwardly disposed legs of the pallet, the pallet shuttle having a generally rectangular configuration, the pallet shuttle having four wheels coupled thereto, the wheels being mateable to a pair of shuttle rails located on the turntable, the pallet shuttle having an upper surface having a longitudinal length and a lateral width and the pallet shuttle having a lower surface having a longitudinal length and a lateral width and a thickness there between, the upper surface of the pallet shuttle having an associated upwardly disposed hydraulic lift;

a travel/lift subsystem operatively coupled to the storage structure, the travel/lift subsystem having an associated travel track located on one side of the storage structure, the travel lift system being operatively coupled to the pallet stack subsystem by the traffic path; and the storage structure having a floor, the storage structure having a rail system therein, with the pallet turntable being located along the side surface of the storage structure.

2. The multilevel vertical general aviation hangar as described in claim 1 further comprising the pallet shuttle having at least one electrical motor associated with the wheels, the motor also coupled to a hydraulic pump and a reservoir and at least one hydraulic fluid tubing thereby providing power to operate the hydraulic pallet lift.

3. A multilevel vertical general aviation hangar, comprising:

a traffic inflow/outflow path having a surface with an associated lighting and traffic direction system, the path having a one directional flow to allow traffic to move in one direction;

a pallet stack subsystem located adjacent to the traffic path, the pallet stack subsystem comprising a pallet rack having a top-of-stack and a bottom-of-stack, with the rack having an associated hydraulic pallet lift subsystem so as to allow a pallet located at the bottom-of-stack to be moved in and out of the rack, with the rack configured to contain at least one pallet, the pallet stack subsystem also having an associated pallet shuttle, with the shuttle having at least one pair of rail mated wheels and a hydraulically upwardly motivated pallet lift;

the pallet having a generally rectangular configuration and being associated with the pallet stack subsystem, with the pallet having a flat planar upper facing vehicle recipient surface and a lower, downward facing, shuttle pallet-lift recipient surface, with the lower surface of the pallet being configured to receive and mate with the hydraulically upwardly motivated pallet lift, the pallet having a thickness between the upper and lower surfaces, with the pallet also having four downwardly disposed corner legs with the legs being disposed a first distance from each other;

a pallet turntable having a diameter line, the turntable being located adjacent the pallet rack and configured to receive a pallet from the pallet rack, with the pallet turntable being located within the traffic inflow/outflow path, with the turntable having at least one associated inflow path leaf thereby coupling the pallet turntable to the traffic inflow and forming a turntable ingress path, and the turntable also having at least one associated outflow path leaf, thereby coupling the pallet turntable to the traffic outflow and forming a turntable egress path, with each leaf coupling the pallet turntable and a pallet that is positioned on the turntable with the traffic path in a continuous fashion, the turntable having a pair of associated shuttle rails located on each side of and about the diameter line of the turntable, the turntable shuttle rails having a rail-to-rail orientation;

a pallet shuttle having a generally rectangular configuration, the pallet shuttle having four wheels and an upper surface having a longitudinal length and a lateral width and the pallet shuttle having a lower surface having a longitudinal length and a lateral width and a thickness there between, the upper surface having an associated upwardly disposed hydraulic lift, the shuttle wheels being coupled to the shuttle and being mateable to the shuttle rails of the turntable, the width of the pallet shuttle being a second distance, with the width of the pallet shuttle being less than the first distance width of the downwardly disposed pallet legs so that the shuttle is able to move between the downwardly disposed legs of the pallet, the pallet shuttle having at least one electrical motor associated with the wheels, the motor also coupled to a hydraulic pump and a reservoir and at least one hydraulic fluid tubing thereby providing power to operate the hydraulic pallet lift;

a storage structure having a generally rectangular configuration with a roof and a floor and supporting side structures, with the side structures defining a structure having a front face and a rear face and two parallel side faces of the structure, the storage structure also having at plurality of levels, with each level having a plurality of pairs of storage rails, with each of the storage rails having a length and a width, with the storage rails having the same configuration and rail-to-rail orientation as the shuttle rails of the turntable so as to allow the shuttle to mate with the storage rails, with each pair of storage rails having a plurality of locations along the length of the pairs of storage rails defined by a coordinate system and a set of coordinates, with each set of coordinates defining a storage space along the length of the storage rails, with each storage space sized to accommodate an airplane therein, with each storage space being identified by use of indicia;

a coordinate storage computer subsystem having a computer with a memory and a processor, the coordinate storage subsystem configured to store the storage space coordinates, with the coordinate storage subsystem also configured to transmit information regarding the location of indicia;

a travel/lift subsystem comprising a generally rectangular upwardly disposed frame having an upper support and a lower support and two parallel side supports, the travel/lift subsystem having an associated hydraulic lift configured to move in an upward and downward direction, the lift also having an associated hydraulic travel system and an associated travel track having a defined length to provide for lateral movement of the travel/lift subsystem in a side-to-side fashion a defined distance of travel along the length of the travel track, with the side to side and up and down movement giving the travel/lift subsystem a two dimensional planar movement along the length of the travel track, the travel/lift subsystem being located adjacent to the turntable and on the opposing side of the turntable from the pallet rack, the travel/lift subsystem being located along one side of the storage structure, with the travel/lift subsystem being electronically coupled to the coordinate storage computer subsystem so that the computer can control the movement of the travel/lift subsystem.

* * * * *